US008845223B2

(12) United States Patent
Liao

(10) Patent No.: US 8,845,223 B2
(45) Date of Patent: Sep. 30, 2014

(54) SLEEVED LEVELING DEVICE WITH AN ANTI-SKID DESIGN

(71) Applicant: Eric Liao, Taichung (TW)

(72) Inventor: Eric Liao, Taichung (TW)

( * ) Notice: Subject to any disclaimer, the term of this patent is extended or adjusted under 35 U.S.C. 154(b) by 65 days.

(21) Appl. No.: 13/753,368

(22) Filed: Jan. 29, 2013

(65) Prior Publication Data

US 2014/0212200 A1 Jul. 31, 2014

(51) Int. Cl.
*B05C 11/00* (2006.01)
*B05C 1/00* (2006.01)

(52) U.S. Cl.
CPC ..... *B05C 1/00* (2013.01)
USPC ..... 401/266; 401/265; 222/566; 222/570

(58) Field of Classification Search
CPC ..... B05C 17/005; B05C 17/00503; B05C 17/00506; B05C 17/00516; B05C 17/00509; B05C 17/00; B65D 35/24; B65D 35/242; B65D 35/36; B65D 35/38
USPC ..... 401/48, 261, 265, 266; 222/566, 567, 222/569, 570, 572, 574
See application file for complete search history.

(56) References Cited

U.S. PATENT DOCUMENTS

| | | | | |
|---|---|---|---|---|
| 5,017,113 | A * | 5/1991 | Heaton et al. | 425/87 |
| 5,588,560 | A * | 12/1996 | Benedict et al. | 222/106 |
| 5,675,860 | A * | 10/1997 | Campbell | 15/235.7 |
| 6,880,198 | B1 * | 4/2005 | Hazard | 15/235.7 |
| 7,972,074 | B2 * | 7/2011 | Lepage | 401/266 |
| 8,308,389 | B2 * | 11/2012 | Yu | 401/261 |

* cited by examiner

*Primary Examiner* — David Walczak
(74) *Attorney, Agent, or Firm* — Banger Shia

(57) ABSTRACT

A sleeved leveling device with an anti-skid design is provided with a sleeve portion and a trimming portion formed at one end of the sleeve portion. Anti-skid ribs formed on the inner peripheral surface of the sleeve portion will produce friction with respect to the nozzle of the sealant gun to ensure that the sleeved leveling device can be firmly sleeved on the sealant gun without falling off. An injection hole of the leveling device has an obtuse angle which enables the sealant to flow out successfully even when the user doesn't hold the leveling device in a perpendicular position to the surface where a seam to be filled is located. Moreover, the inner trimming surface of the trimming portion is arc-shaped, so that remnant sealant will be collected in the center of the inner trimming surface without overflowing, and the cleanliness of seam-filling operation is assured.

3 Claims, 12 Drawing Sheets

SLEEVED LEVELING DEVICE WITH AN ANTI-SKID DESIGN

BACKGROUND OF THE INVENTION

1. Field of the Invention

The present invention relates to a leveling device, and more particularly to a sleeved leveling device with an anti-skid design used in construction.

2. Description of the Prior Art

In construction work, resin or silicon is usually used as sealant to fill into the seam between walls, and for aesthetic purposes, the constructor has to levels the sealant filled into the seam with a traditional plastering trowel 10, as shown in FIG. 1. The plastering trowel 10 includes a handle 11 and a plate 12 fixed to the end of the handle 11. The sealant is filled into the seam with a sealant gun, and then is leveled with the plastering trowel 10. Therefore, seam filling is inconvenient since it requires the use of different tools.

To make the seam filling operation easier, a trimming device 20 was invented as shown in FIG. 2, which is provided with a connecting portion 21 and a trimming piece 22 fixed on the connecting portion 21. The connecting portion 21 is screwed on a sealant gun A and includes a sealant injection nozzle 211. Sealant can be injected into the seam by the sealant injection nozzle 211 and then leveled with the trimming piece 22, so that it doesn't require the use of different tools during the seam sealing operation. However, the connecting portion 21 of the trimming device 20 has to fit on the sealant gun A, in other words, the sealant gun A should be specially sized and configured to fit the connecting portion 21, and the trimming device 20 doesn't fit the ordinary sealant guns available on the market.

FIGS. 3 and 4 show another trimming tool 30 which includes a conical portion 31 and a support portion 32 at one end of the conical portion 31. At another end of the conical portion 31 are formed a triangular trimming portion 33 and a nozzle 34 located between the trimming portion 33 and an edge 341. The trimming tool 30 is designed to sleeve on the ordinary sealant guns available on the market, and sealant is outputted from the nozzle 34 and leveled with the trimming portion 33. However, the trimming tool 30 cannot be fixed by itself on the sealant gun due to its inner surface is flat and smooth, the user has to push the support portion 32 against the sealant gun with fingers when doing the leveling, otherwise, the trimming tool 30 is very likely to fall off.

In addition, the trimming portion 33 of the trimming tool 30 is a triangular sheets structure. Suppose a tangent line T of the top end 311 of the conical portion 31 of the trimming tool 30 is perpendicular to the trimming portion 33, and an angle θ which is acute is defined between the trimming portion 33 and the edge 341. When the angle θ is acute, it means that the nozzle 34 is close to the trimming portion 33 and the tangent line T of the top end 311. In this case, the user has to hold the trimming tool 30 in an almost perpendicular position to the surface where the seam is to be filled in order for the sealant to be injected out of the nozzle without difficulties. In addition to the inconvenience of use caused, holding the trimming tool in a perpendicular position only enables the trimming portion 33 to contact the surface where the seam is located with the smallest contact area, and the sealant is very likely to leak out via the part of the surface where the trimming portion 33 didn't touch, so that the user has to do the leveling of the sealant for many more times.

The present invention has arisen to mitigate and/or obviate the afore-described disadvantages.

SUMMARY OF THE INVENTION

The primary objective of the present invention is to provide a sleeved leveling device with an anti-skid design, which is capable of overcoming the problem of the conventional trimming tool that the user has to manually hold the conventional trimming tool in a perpendicular position to the surface where the seam to be filled is located.

To achieve the above objective, a sleeved leveling device with an anti-skid design in accordance with the present invention comprises a sleeve portion and a trimming portion formed at one end of the sleeve portion.

The sleeve portion is a hollow conical structure with a sealant injection end formed at the one end, and another end expands outward to form an annular flange, the sealant injection end is provided with a slanting surface, the sleeve portion includes an outer peripheral surface and an inner peripheral surface, on the inner peripheral surface are formed a plurality of anti-skid ribs.

The trimming portion is formed at the sealant injection end of the sleeve portion and is a triangle structure with a top end and two lateral ends, the top end is an arc-shaped structure with a smooth surface, the trimming portion includes an inner trimming surface and an outer trimming surface, the inner trimming surface is an arc-shaped surface and connected to the slanting surface, an injection hole penetrates from the inner trimming surface to the slanting surface to form an obtuse angle between the inner trimming surface and the slanting surface, the outer trimming surface is connected to the outer peripheral surface of the sleeve portion.

The anti-skid ribs formed on the inner peripheral surface of the sleeve portion will produce friction with respect to the nozzle of the sealant gun to ensure that the sleeved leveling device of the present invention can be firmly sleeved on the sealant gun without falling off. Since the injection hole has an obtuse angle, the sealant is still able to flow out even if the user doesn't hold the leveling device of the present invention in a perpendicular position to the surface where the seam to be filled is located. Moreover, the inner trimming surface of the trimming portion is arc-shaped, remnant sealant will be collected in the center of the inner trimming surface without overflowing when the inner trimming surface is leveling the sealant, and thus the cleanliness of seam-filling operation is assured.

DETAILED DESCRIPTION OF THE PREFERRED EMBODIMENTS

Figure 1:
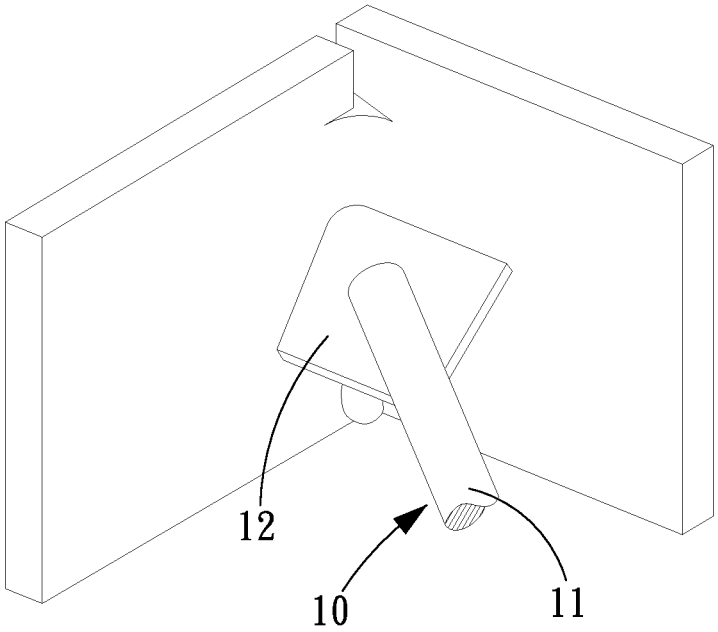
FIG. 1 PRIOR ART
FIG. 1 shows a conventional plastering trowel is used to level the sealant filled in the seam between walls.
Figure 2:
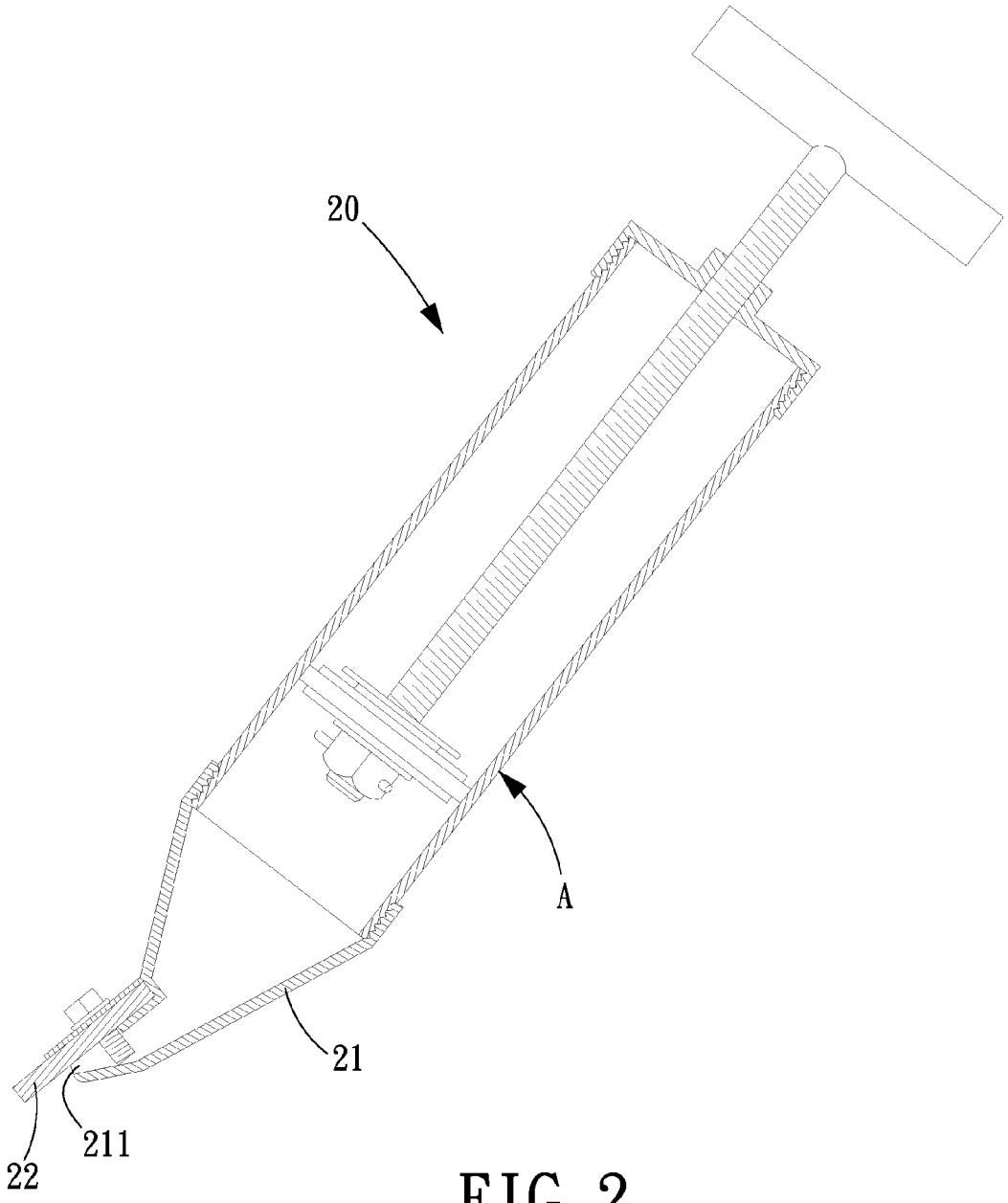
FIG. 2 PRIOR ART
FIG. 2 shows another conventional trimming tool.
Figure 3:
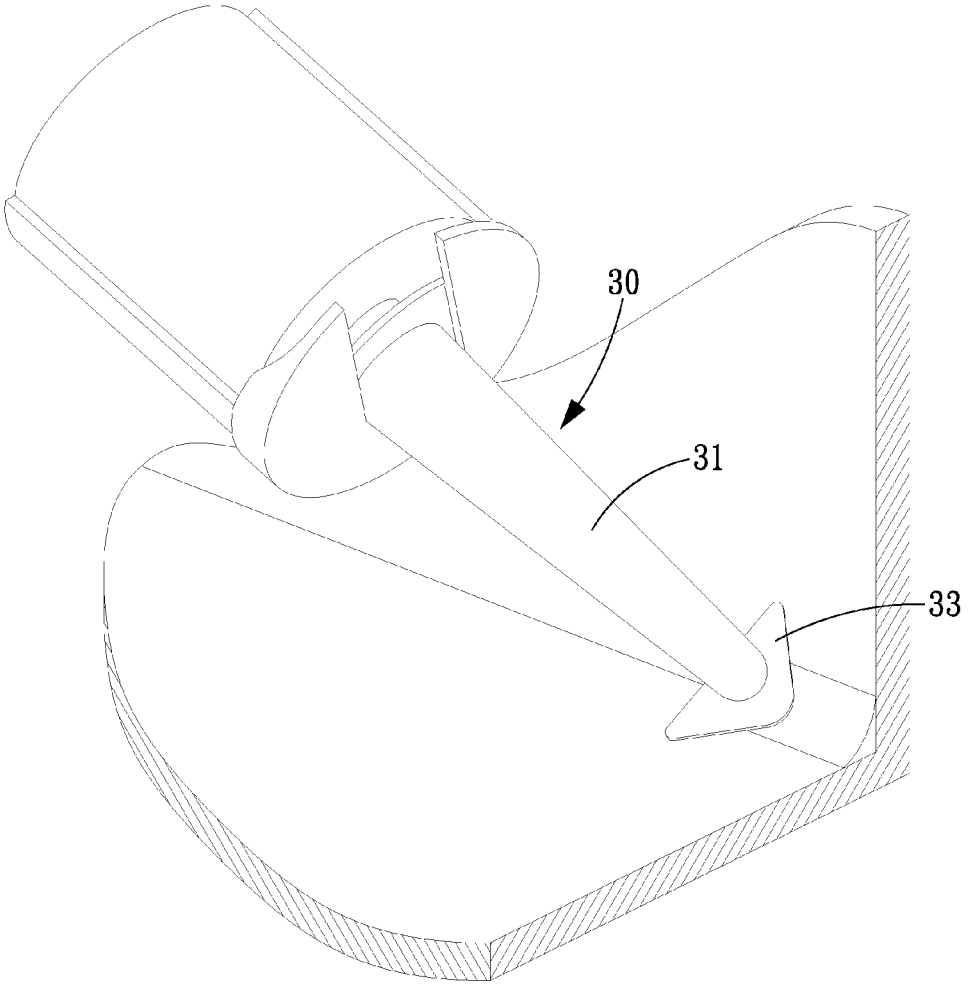
FIG. 3 PRIOR ART
FIG. 3 shows a conventional trimming tool is used to level the sealant filled in the seam between walls.
Figure 4:
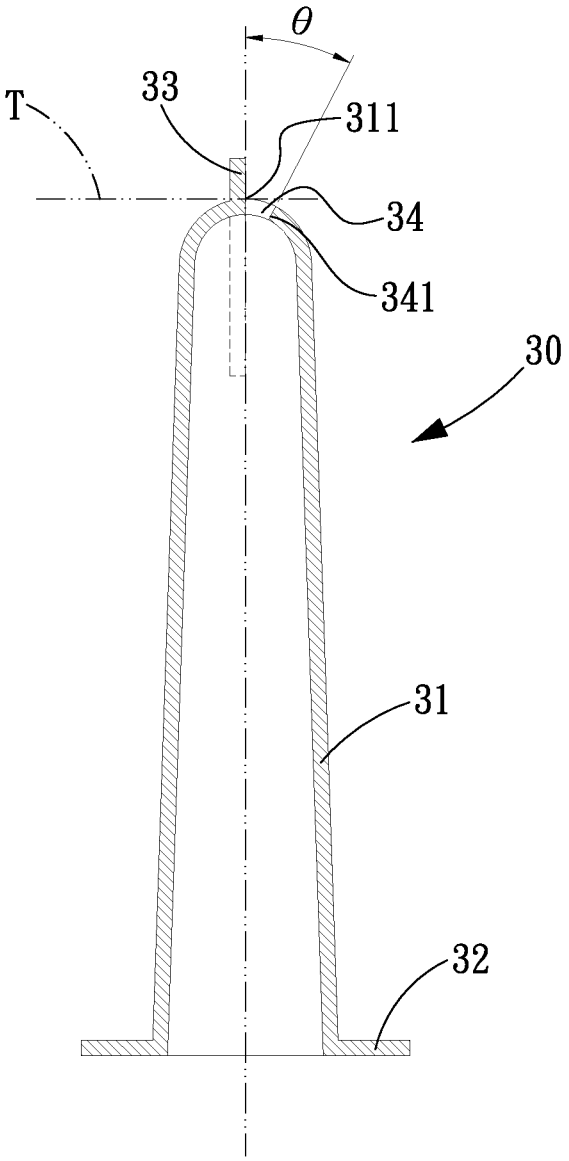
FIG. 4 PRIOR ART
FIG. 4 is a cross sectional view of the conventional trimming tool shown in FIG. 3.
Figure 5:
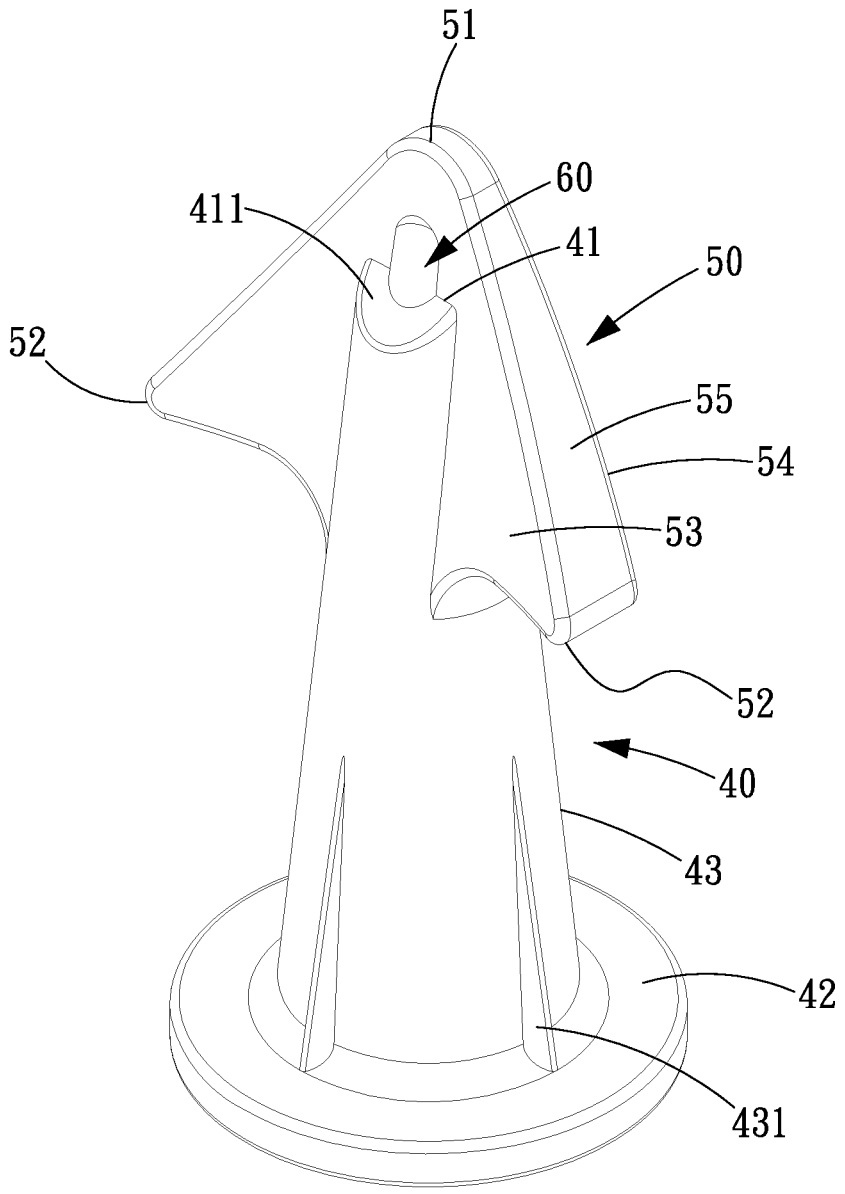
FIG. 5 is a perspective view of a sleeved leveling device with an anti-skid design in accordance with a preferred embodiment of the present invention.
Figure 6:
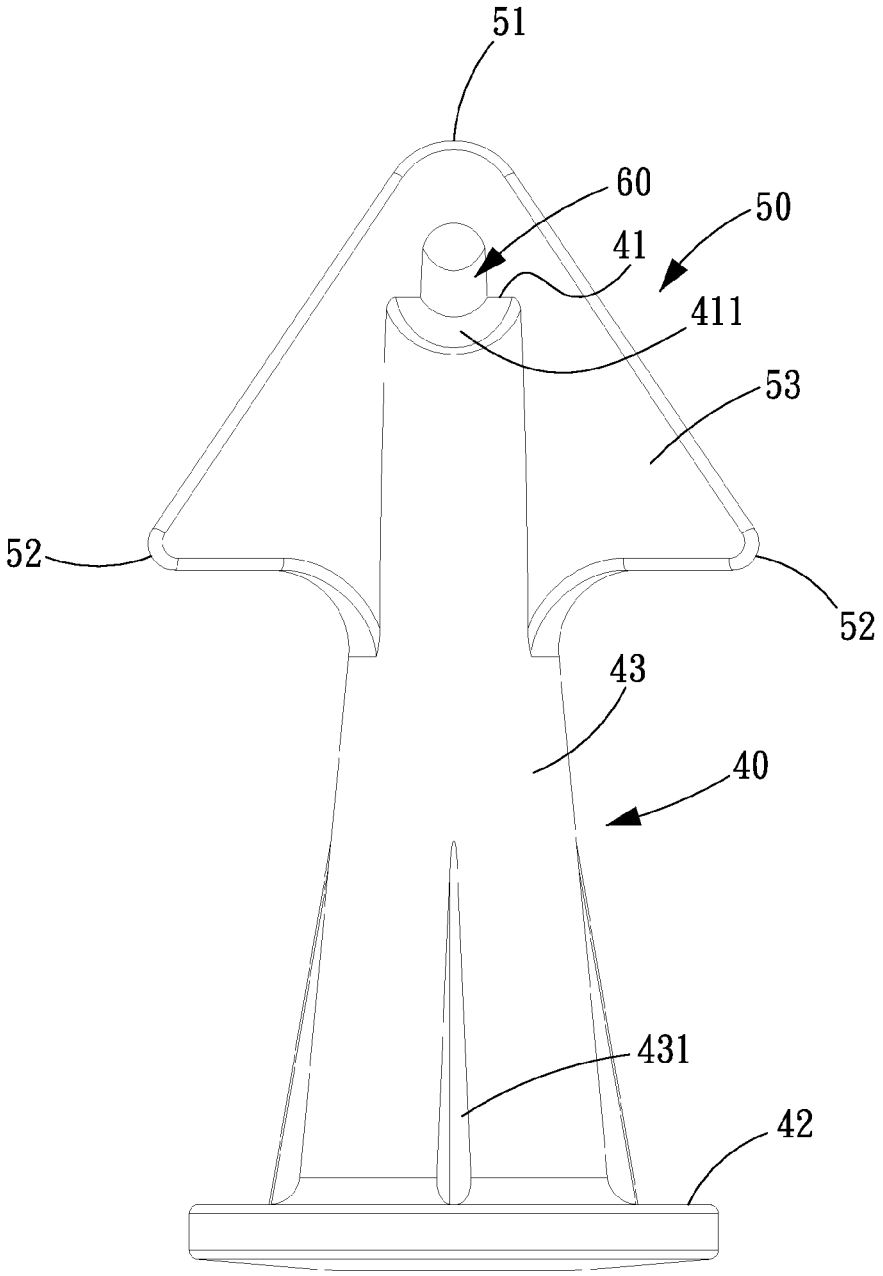
FIG. 6 is a plan view of the sleeved leveling device with an anti-skid design in accordance with the present invention.
Figure 7:
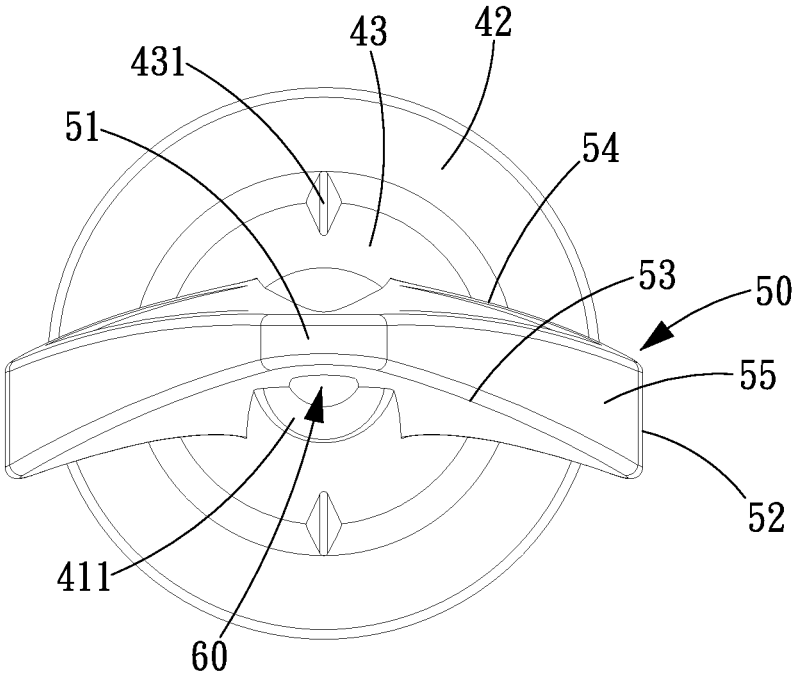
FIG. 7 is a top view of the sleeved leveling device with an anti-skid design in accordance with the present invention.
Figure 8:
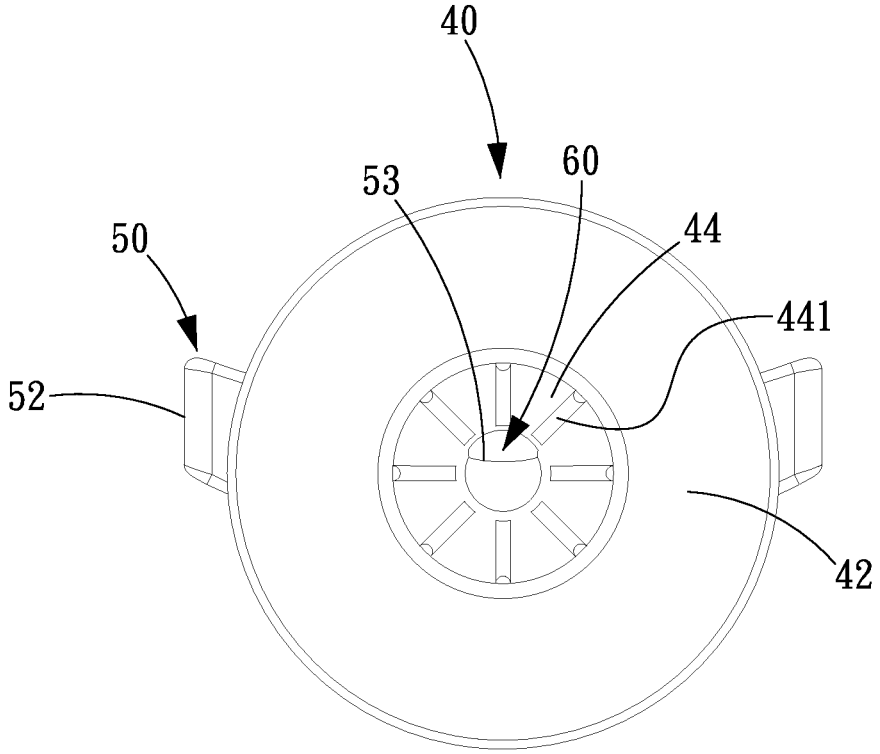
FIG. 8 is a bottom view of the sleeved leveling device with an anti-skid design in accordance with the present invention.
Figure 9:
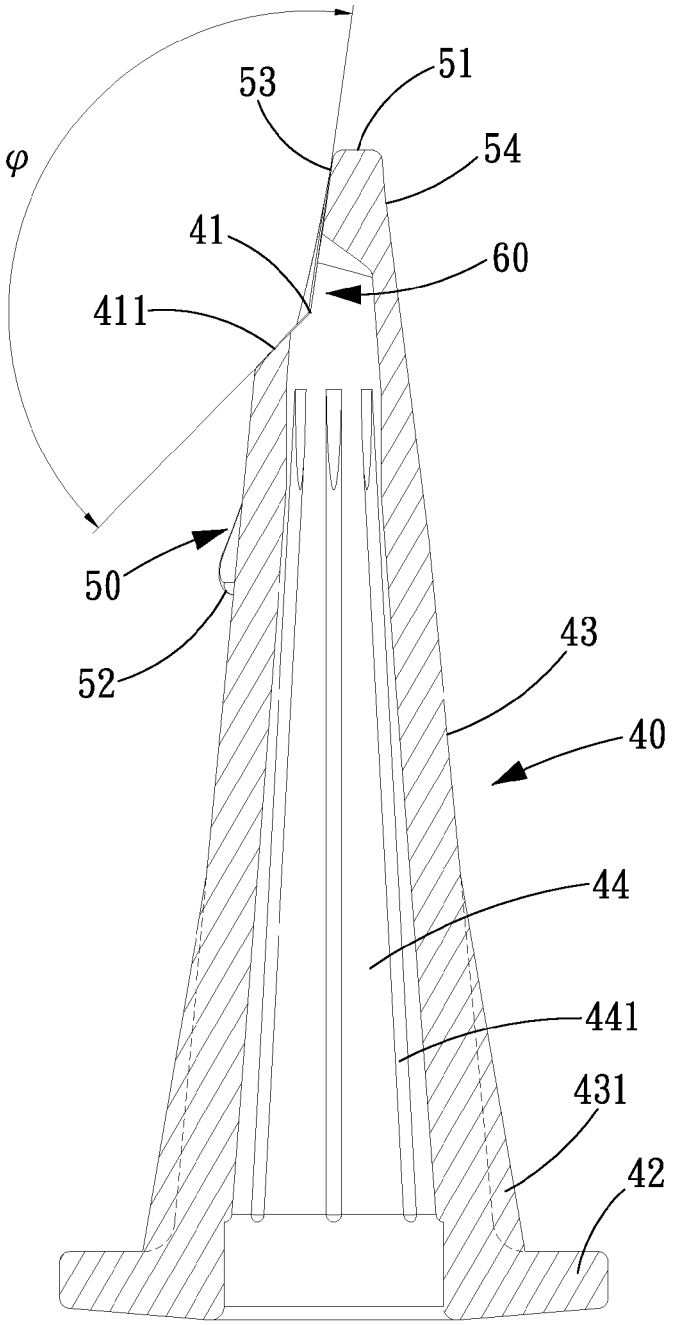
FIG. 9 is a cross sectional view of the sleeved leveling device with an anti-skid design in accordance with the present invention.

The present invention will be clearer from the following description when viewed together with the accompanying drawings, which show, for purpose of illustrations only, the preferred embodiment in accordance with the present invention.

Referring to FIGS. 5-10, a sleeved leveling device with an anti-skid design in accordance with a preferred embodiment of the present invention is made of elastic material, rubber for instance. The leveling device is to be coupled to a nozzle A1 of a sealant gun A and comprises: a sleeve portion 40 and a trimming portion 50.

The sleeve portion 40 is a hollow conical structure with a sealant injection end 41 formed at one end, and another end expands outward to form an annular flange 42. The sealant injection end 41 is provided with a slanting surface 411. The sleeve portion 40 includes an outer peripheral surface 43 and an inner peripheral surface 44. On the outer peripheral surface 43 of the sleeve portion 40 are formed a plurality of gripping ribs 431, and on the inner peripheral surface 44 are formed a plurality of anti-skid ribs 441.

The trimming portion 50 is integrally formed at the sealant injection end 41 of the sleeve portion 40 and is a triangle structure with a top end 51 and two lateral ends 52. The top end 51 is an arc-shaped structure with a smooth surface. The trimming portion 50 includes an inner trimming surface 53 and an outer trimming surface 54. The inner trimming surface 53 is an arc-shaped surface and connected to the slanting surface 411. An injection hole 60 penetrates from the inner trimming surface 53 to the slanting surface 411, namely, the injection hole 60 extends from the inner trimming surface 53 to the slanting surface 411 to form an angle $\phi$ between the inner trimming surface 53 and the slanting surface 411, and the angle $\phi$ is an obtuse angle. The outer trimming surface 54 is connected to the outer peripheral surface 43 of the sleeve portion 40. Between the inner and outer trimming surfaces 53, 54 is a lateral surface 55 which extends from the two lateral ends 52 and tapers toward the top end 51.

Figure 10:
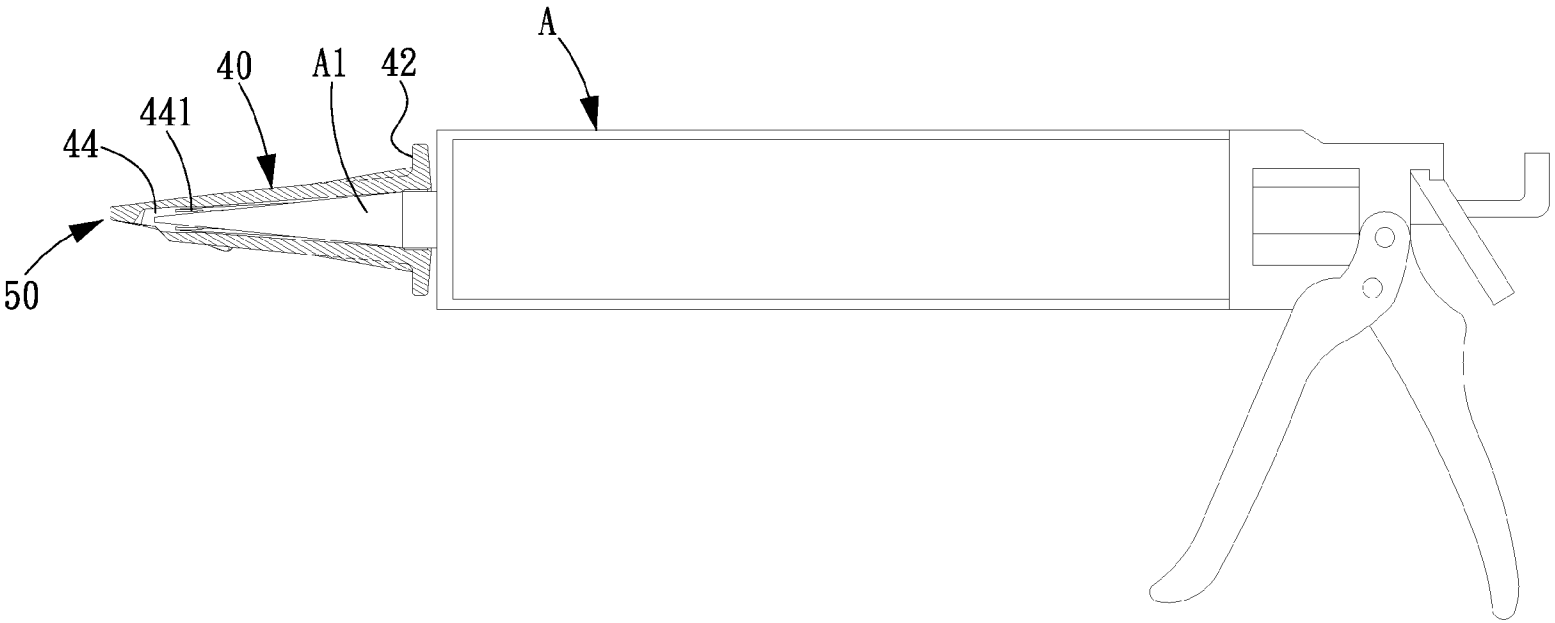
FIG. 10 shows that of the sleeved leveling device with an anti-skid design in accordance with the present invention is sleeved on a sealant gun.
Figure 11:
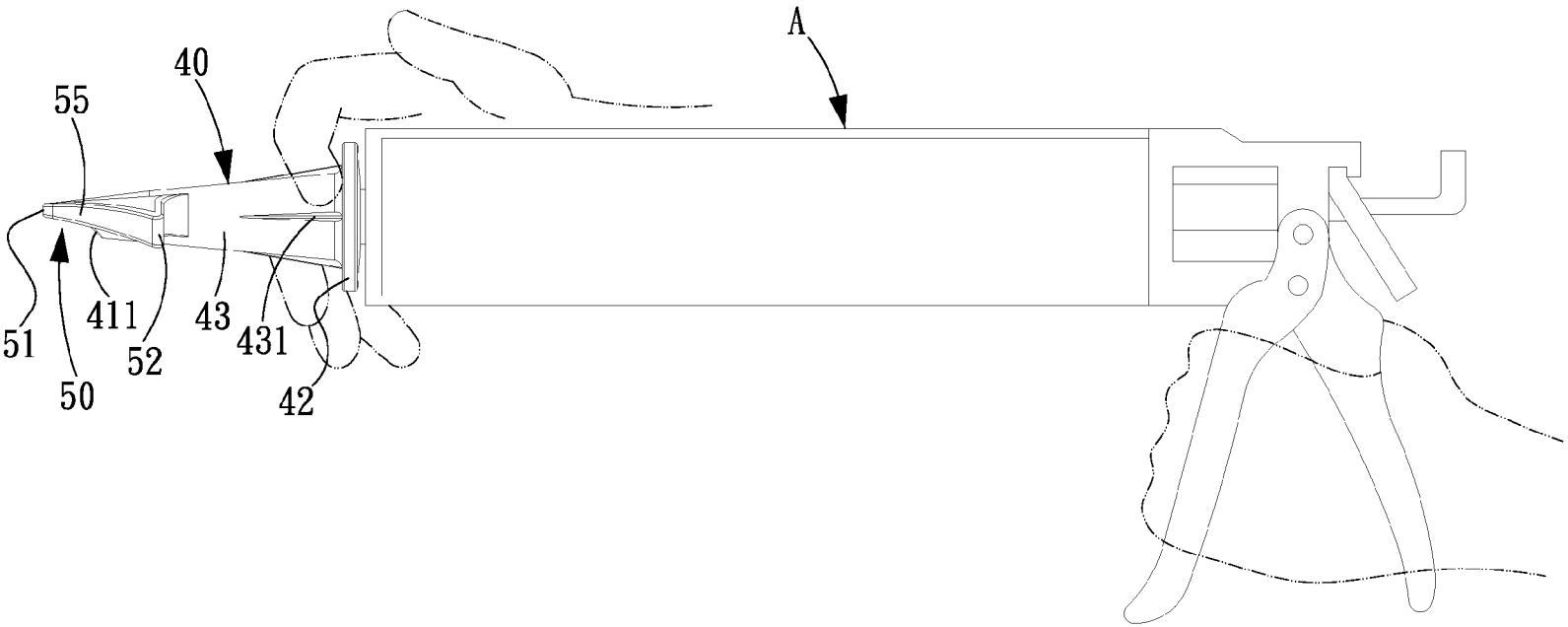
FIG. 11 is an illustrative view of the present invention showing that a user holds the sealant gun with one hand while pressing the flange between the gripping ribs of the leveling device with the fingers of another hand.

When in use, the sleeve portion 40 of the sleeved leveling device of the present invention is sleeved on the nozzle A1 of the sealant gun A, as shown in FIG. 10, and the inner peripheral surface 44 of the sleeve portion 40 is brought into contact with the nozzle A1, the anti-skid ribs 441 will produce friction with respect to the nozzle A1 to ensure that the sleeved leveling device of the present invention can be firmly sleeved on the sealant gun A without falling off.

For easy operation, the user can also hold the sealant gun A with one hand while pressing the flange 42 between the gripping ribs 431 with the fingers of another hand, and the design of the gripping ribs 431 allows the user to hold the sleeve portion 40 with less effort, and the sleeved leveling device of the present invention can be prevented from falling off or rotating.

To fill a seam, the inner trimming surface 53 of the trimming portion 50 of the sleeved leveling device which is sleeved on the nozzle A1 of the sealant gun A can be turned toward the seam, and then the sealant gun A is pressed, the sealant will flow to the sleeve portion 40 from the nozzle A1 and will finally be ejected out of the injection hole 60. When the sealant is being ejected out of the injection hole 60, the user can move the sealant gun A in such a manner the smooth top end 51 of the trimming portion 50 is pressed against and moves along the seam to level the sealant filled in the seam. Hence, the sealant can be filled in the seam while being leveled at the same time by the leveling device of the present invention.

Since the injection hole 60 is formed on the inner trimming surface 53 and extends to the slanting surface 411 and has an obtuse angle $\phi$, the sealant is still able to flow out even if the user doesn't hold the leveling device of the present invention in a perpendicular position to the surface where the seam to be filled is located. Moreover, the inner trimming surface 53 of the trimming portion 50 is arc-shaped, remnant sealant will be collected in the center of the inner trimming surface 53 without overflowing when the inner trimming surface 53 is leveling the sealant, and thus the cleanliness of seam-filling operation is assured.

Figure 12:
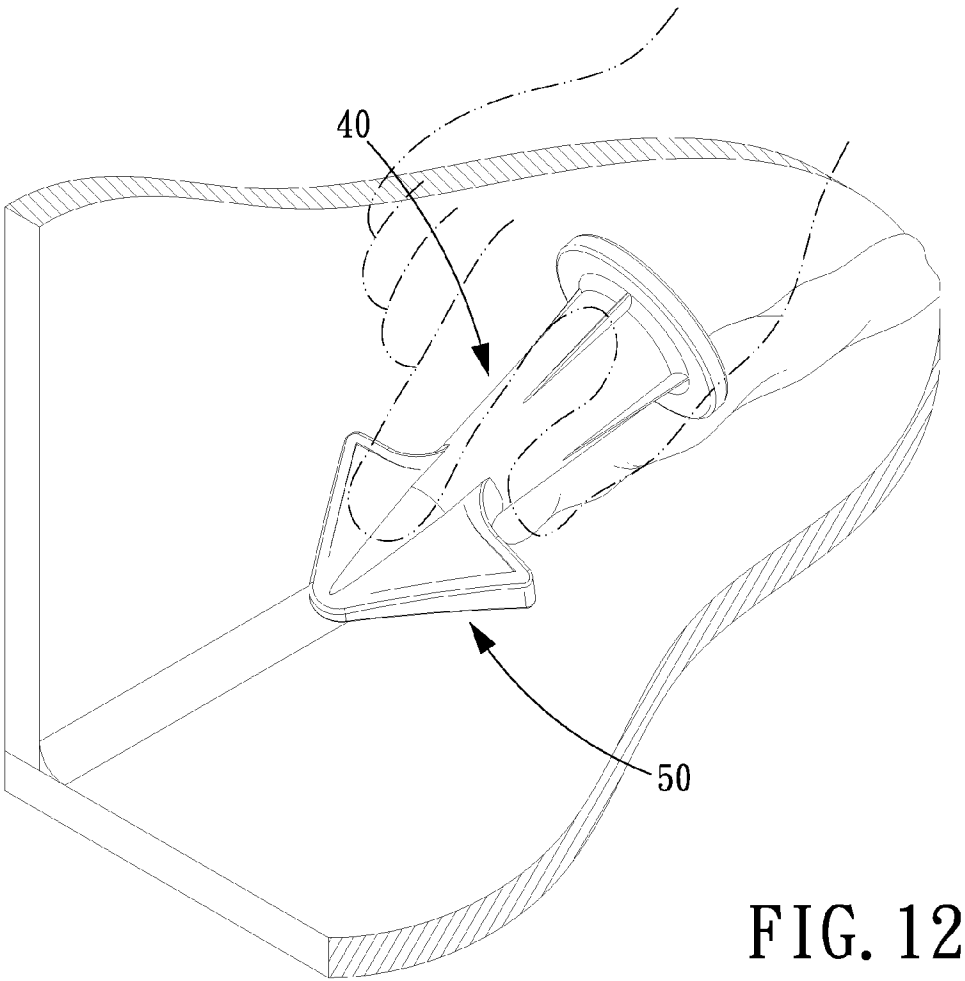
FIG. 12 shows that the sleeved leveling device in accordance with the present invention is used to level the sealant filled in the seam between walls.

In addition to being used in combination with the sealant gun A, the sleeved leveling device with anti-skid design in accordance with the present invention can also be used alone, as shown in FIG. 12, the user can choose to fill the sealant in the seam, and then directly holds the sleeve portion 40 to trim and level the sealant.

While we have shown and described various embodiments in accordance with the present invention, it is clear to those skilled in the art that further embodiments may be made without departing from the scope of the present invention.

What is claimed is:

1. A sleeved leveling device with an anti-skid design comprising a sleeve portion and a trimming portion formed at one end of the sleeve portion; wherein:

the sleeve portion is a hollow conical structure with a sealant injection end formed at the one end, and another end expands outward to form an annular flange, the sealant injection end is provided with a slanting surface, the sleeve portion includes an outer peripheral surface and an inner peripheral surface, on the inner peripheral surface are formed a plurality of anti-skid ribs;

the trimming portion is formed at the sealant injection end of the sleeve portion and is a triangle structure with a top end and two lateral ends, the top end is an arc-shaped structure with a smooth surface, the trimming portion includes an inner trimming surface and an outer trimming surface, the inner trimming surface is an arc-shaped surface and connected to the slanting surface, an injection hole penetrates from the inner trimming surface to the slanting surface to form an obtuse angle between the inner trimming surface and the slanting surface, the outer trimming surface is connected to the outer peripheral surface of the sleeve portion.

2. The sleeved leveling device with an anti-skid design as claimed in claim 1, wherein a plurality of gripping ribs are formed on the outer peripheral surface of the sleeve portion.

3. The sleeved leveling device with an anti-skid design as claimed in claim 1, wherein a lateral surface is formed between the inner and outer trimming surfaces, and extends from the two lateral ends and tapers toward the top end.

* * * * *